US005511675A

United States Patent [19]

Frederick

[11] Patent Number: 5,511,675

[45] Date of Patent: Apr. 30, 1996

[54] SIMPLIFIED FILING SYSTEM

[75] Inventor: Martin Frederick, New York, N.Y.

[73] Assignee: Unique Filing & Storage, Ltd., Plainview, N.Y.

[21] Appl. No.: 148,595

[22] Filed: Nov. 8, 1993

[51] Int. Cl.[6] ..... A47F 5/00

[52] U.S. Cl. ..... 211/193; 211/94; 211/94.5; 211/162

[58] Field of Search ..... 211/193, 94, 162, 211/128, 126, 151, 187, 94.5

[56] References Cited

U.S. PATENT DOCUMENTS

| | | | |
|---|---|---|---|
| 2,064,096 | 12/1936 | Whalen | 211/151 |
| 3,038,613 | 6/1962 | Sylvester et al. | 211/162 |
| 3,047,158 | 7/1962 | Scholl | 211/126 |
| 3,210,143 | 7/1963 | Frederick | 312/281 |
| 3,465,897 | 7/1966 | Schumann et al. | 211/151 |
| 4,227,466 | 10/1980 | Rooklyn | 108/93 |
| 4,228,906 | 10/1980 | Jones | 211/126 |
| 4,898,284 | 2/1990 | Arens | 211/162 |
| 5,086,936 | 2/1992 | Remmers | 211/126 |
| 5,205,421 | 4/1993 | Bustos | 211/59.2 |

*Primary Examiner*—Robert W. Gibson, Jr.
*Attorney, Agent, or Firm*—Lieberman & Novak

[57] ABSTRACT

A simplified filing system which can be mounted on a stand-alone support structure, or mounted on a support structure that attaches directly to a wall in a storage area. The filing system comprises rows of support carriages for storage with all but the bottom row capable of lateral movement via a roller assembly to permit access to lower rows of storage areas. The support carriages contain hanging files or storage baskets to store a variety of documents or other items for storage.

15 Claims, 7 Drawing Sheets

SIMPLIFIED FILING SYSTEM

FIELD OF THE INVENTION

The present invention relates generally to a simplified filing system for use in offices, stores, warehouses and the like, in which moveable carriers for hanging files or plastic storage drawers are mounted on a stand-alone support structure, or mounted on a support structure that attaches directly to a wall.

BACKGROUND OF THE INVENTION

Numerous types of filing/storage systems are currently in wide use in the business world. Such systems range from large automated warehouse storage systems in which storage and retrieval is under computer control, to the basic office filing cabinet.

Even the basic filing cabinet, however, tends to be bulky, difficult to move to new locations and often expensive. Most importantly, even the simplest filing systems currently in existence lack expansion flexibility, as they do not provide the ability to expand as filing needs increase without purchasing complete, additional units, which take up necessary space and add unnecessary expense to the cost of doing business.

It is, therefore, an object of the instant invention to provide a simplified filing system that is inexpensive and readily expandable as filing needs increase.

One simplified prior art filing system is described in U.S. Pat. No. 3,210,143, granted to Phillip Frederick on Oct. 5, 1965. In this system, there is provided a frame or cabinet, in the rear of which are fixed a predetermined number of rows of compartments, such rows being aligned laterally and vertically. Means are provided in the compartments for the storage of various items. Such storage means may be ordinary file drawers, or may be other means of storage.

Vertical posts are provided between some or all of the rear compartments serving as means for retaining horizontal tracks. Such tracks are secured to the vertical posts at points between the vertical rows of compartments. There is also provided a series of individual laterally moveable cradles in front of the rear fixed cradles, which are hung on the horizontal tracks. The number of laterally moveable cradles is less than the number of fixed compartments in each of the horizontal rows of compartments. Means are provided whereby the front cradles may be readily mounted onto the tracks and further means are provided for stabilizing the front cradles against accidental displacement.

Although this system was an improvement over the prior art in 1965, it still lacked the ability for rapid expansion and storage capability, and was relatively expensive due to the fixed cabinet arrangement and the relative massive system of tracks required for the moveable storage carriers.

It is, therefore, a further object of the instant invention to provide an inexpensive filing system that may be used with a self-contained stand alone aluminum structure, or may be mounted directly on the wall of a storage area, to provide a low cost and readily expandable filing system.

SUMMARY OF INVENTION

In accordance with the invention, a simplified filing system is provided including a plurality of horizontal support members, each having attached thereto a plurality of vertical support members, with a plurality of horizontal support beams being attached at predetermined locations to the vertical support members.

It is a feature of the invention that each of the horizontal support beams include an upper and lower guide portion with selected ones of the plurality of support carriages releasably attached to the upper and lower guide portions via a selected roller assembly.

It is another feature of the invention that the support carriages are arranged in a plurality of horizontal rows, with a lower row of support carriages maintained in a fixed position and upper rows of support carriages being movable laterally along the horizontal support beams.

It is still another feature of the invention that the upper rows of support carriages are moveable so as to obtain access to lower rows of support carriages.

It is another feature of the invention that the horizontal support beam which supports the support carriage can be mounted directly to a wall in a storage area as opposed to the vertical support members.

It is a still further and general feature of the invention that the instant simplified filing system is readily expandable as filing needs increase.

The foregoing and other objects and features of the instant invention will be more fully understood from the following description of an illustrated embodiment thereof in conjunction with the accompanying drawings.

DETAILED DESCRIPTION OF THE INVENTION

Figure 1:
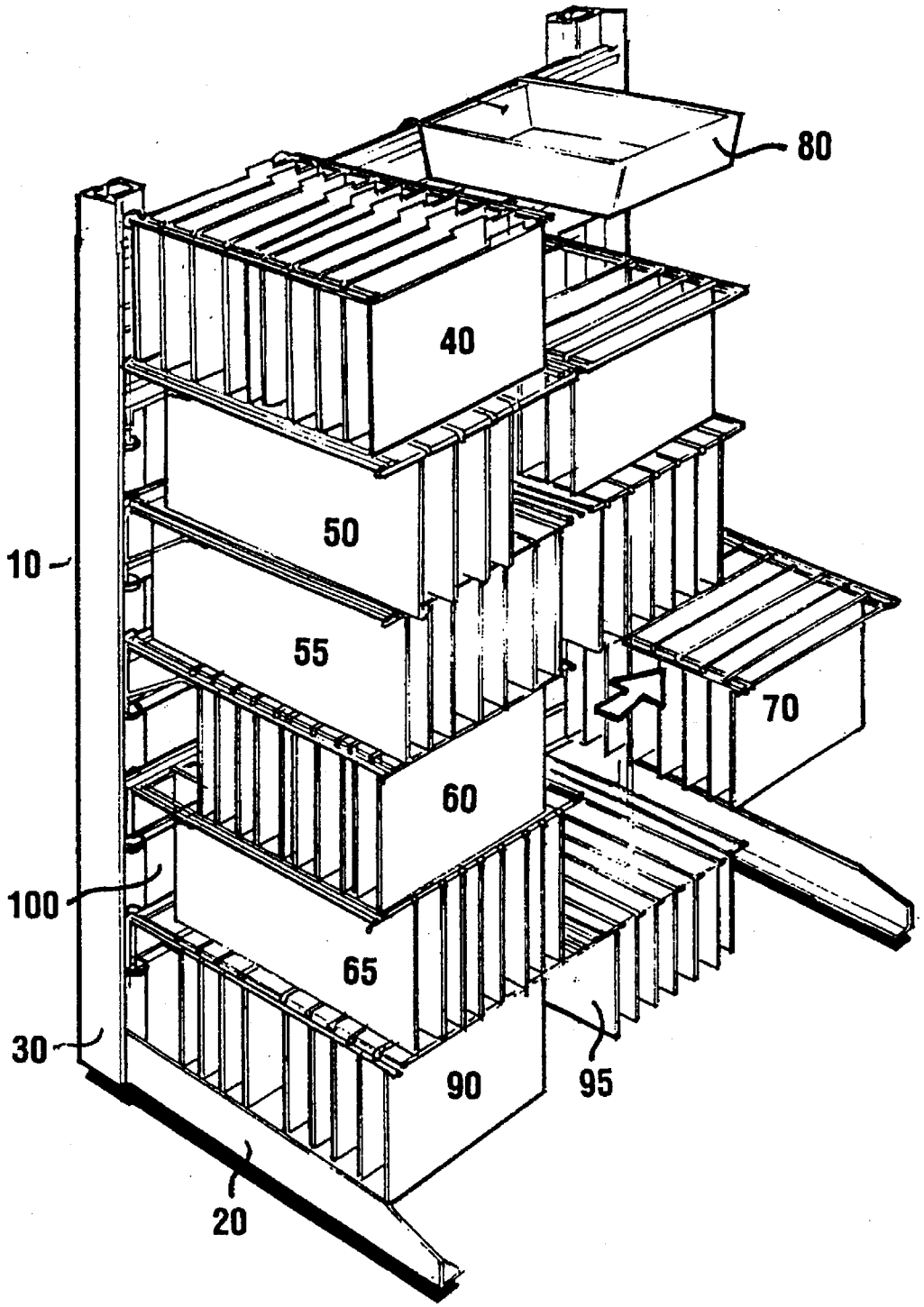
FIG. 1 illustrates a perspective view of the filing system of the instant invention.

Referring now to FIG. 1, the simplified filing system 10 of the instant invention, consists of a stand alone aluminum structure, which includes horizontal member 20 and vertical member 30, which together comprise an L-shaped support structure upon which the filing system is supported.

Movable carriers, such as carriers 40, 50, 55, etc., are attached to horizontal members, such as member 100 in a manner to be described below. Horizontal member 100 is in turn attached to vertical member 30, or may be attached directly to a wall as will be described.

All carriers, such as carriers 40, 50, 55, 60, 65, 70 and 80, are laterally movable. The bottom row of carriers, 90 and 95, are preferably fixed in position. In this manner, carriers 65 and 70 can be moved laterally to provide access to carriers 90 and 95. Similarly, carriers such as carriers 50, 55 are also moveable laterally to provide access to lower storage areas.

An option for the filing system, as will be described in greater detail below, is storage tray 80, which is hung on a movable carrier and consists of a bin in which objects, other than standard documents, can be stored. It is to be understood that each of the hanging file type movable carriers 40, 50, 55, 60, 65, 70, 90 and 95, could be replaced with individual bins such as the ones shown at 80, in order to store objects as opposed to paper files. The structure supporting each of the hanging files will be described in greater detail below.

Figure 2:
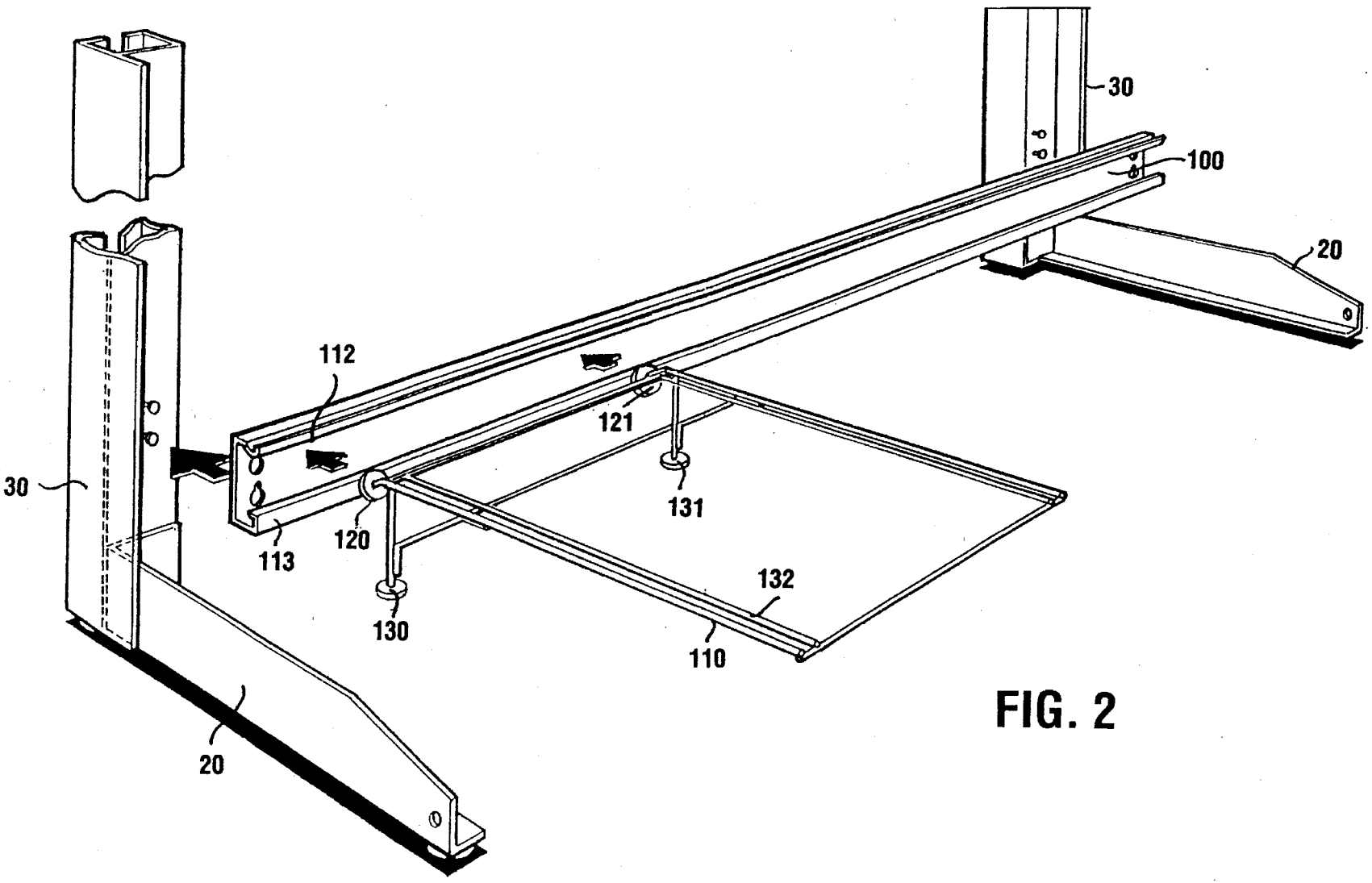
FIG. 2 illustrates means of attaching the filing system to the stand alone aluminum structure.

Referring now to FIG. 2, there is shown a schematic view of the support system for the simplified filing system shown in FIG. 1. More particularly, vertical members 30 and horizontal members 20, form a support structure upon which horizontal member 100 can be mounted. It is to be understood that horizontal member 100 can be mounted to the stand alone aluminum support structure 20, 30, as described above with appropriate fasteners, or alternatively can be mounted directly to a wall in a storage area. For example, fastener access holes may be provided in horizontal member 100 so that appropriate fasteners can connect directly to sixteen inch center studs in a wall.

Attached to horizontal member 100 is carriage 110. Carriage 110 consists of rollers 120, 121, 130 and 131, as well as a wire support structure 132. As will be described below, rollers 120 and 121 cooperate with guide 112, and rollers 130 and 131 cooperate with guide 113 such that carriage 110 has adequate support for files placed therein, and also can be moved laterally in either direction in order to provide access to filing areas directly below the file being moved.

It is, of course, to be understood that hanging files would be placed within wire support structure 132 in the manner shown in FIG. 1. Also, a storage bin, such as storage bin 80 in FIG. 1, would have attached thereto rollers 120, 121, 130 and 131 in any well-known manner so that storage bin 80 would move laterally in the manner described above.

Figure 3:
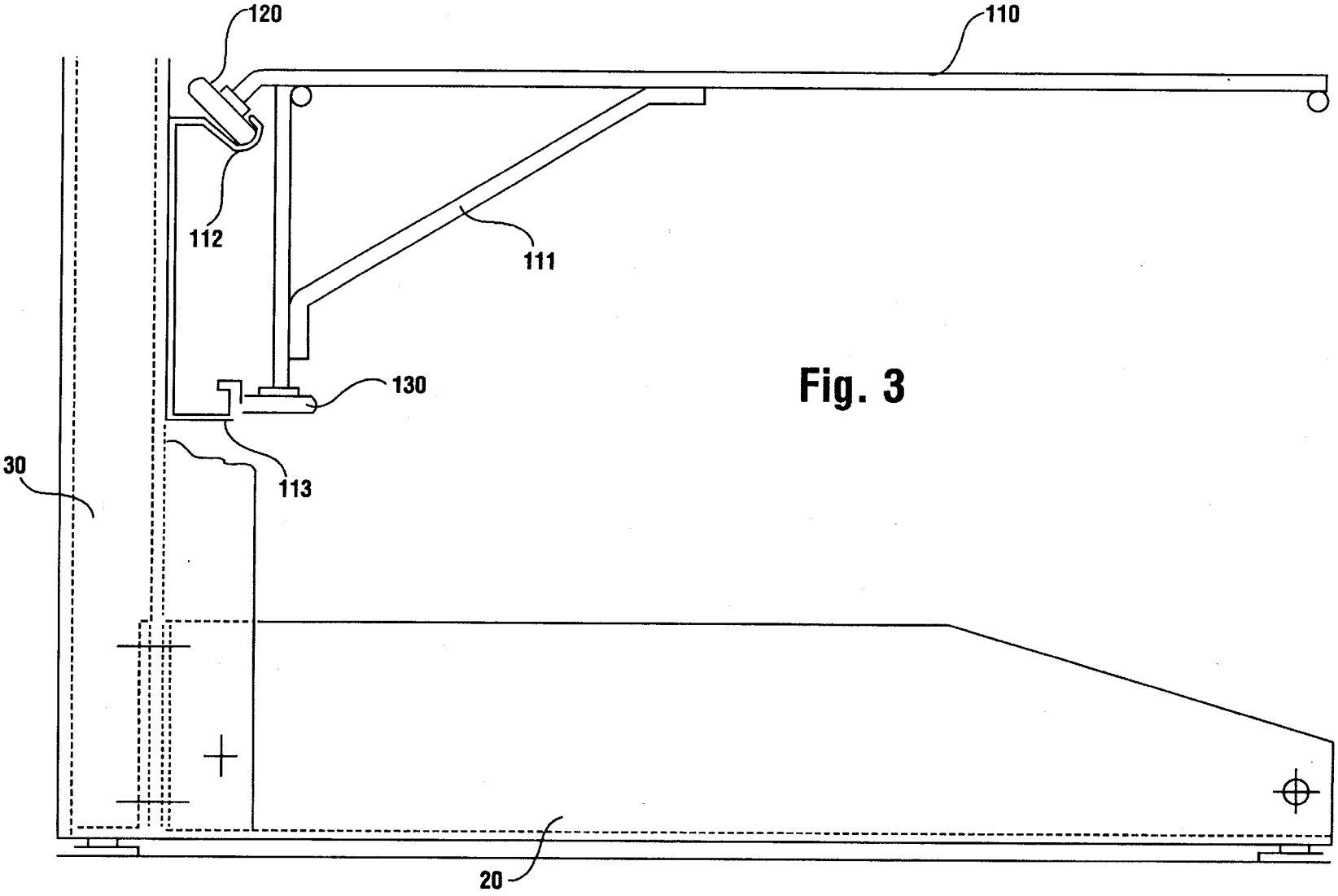
FIG. 3 illustrates a side view of the stand alone aluminum structure, along with the manner in which the hanging files are connected to the structure.

Referring now to FIG. 3, there is shown a side view of the support structure previously described in conjunction with FIG. 2. As can be seen, vertical member 30 and horizontal member 20 cooperate to provide a stand alone support structure as described. Carriage 110 includes rollers 120 and 130, which allow carriage 110 to be moved laterally from side to side. Roller 120 fits within the recess of guide 112 as shown in FIG. 3. Similarly, roller 130 abuts a flange portion of guide 113 to provide support for carriage 110. The support member 111 is mounted between the vertical portion of the carriage, and the horizontal portion of the carriage 11 0, in order to provide additional support for files or other stored matters.

Figure 4C:
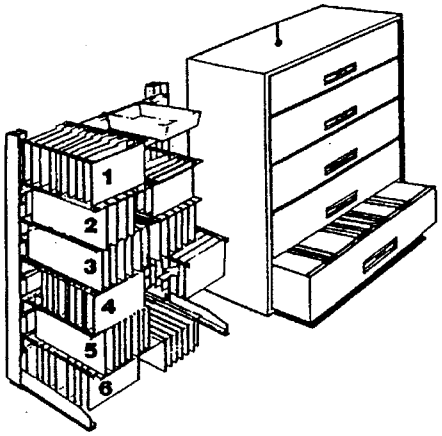
FIGS. 4A, 4B and 4C illustrate various options available with the filing system of the instant invention.
Figure 4B:
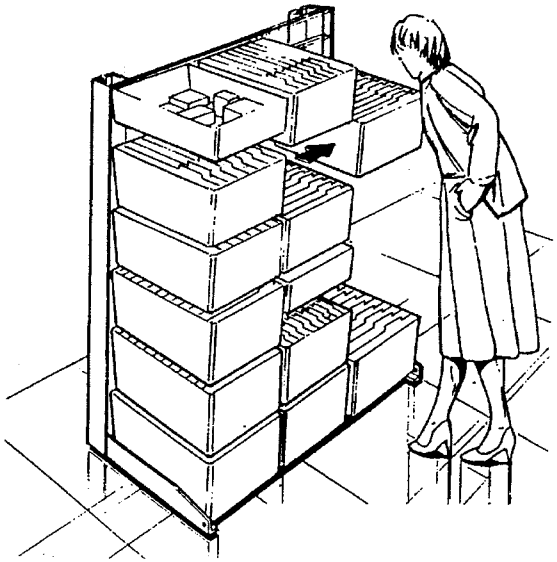
Figure 4A:
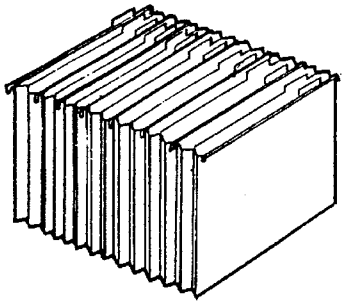

Referring now to FIGS. 4A, 4B and 4C, FIG. 4A illustrates the use of an optional accordion hanging file which may be useful for some storage applications. FIG. 4B illustrates the simplified filing system of the instant invention in which molded plastic containers, such as storage bin 80 described with respect to FIG. 1, are used throughout the filing system, allowing either the storage of paper files, or alternatively the storage of various other non-paper items. FIG. 4C illustrates the six layers of the simplified filing system and compares the simplicity of the instant inventive system with a standard lateral file shown on the right in FIG. 4C. As illustrated, the standard lateral file shown in FIG. 4C is substantially more bulky and, thus, more difficult to relocate than the simplified filing system of the instant invention. In addition, the instant invention can be readily expanded by adding additional support members such as members 20, 30 and 100 (FIG. 2), along with additional movable carriers such that great flexibility in accommodating new storage requirements is readily accomplished. In addition, the filing system of the instant invention is substantially less expensive than prior art filing systems.

Figure 5:
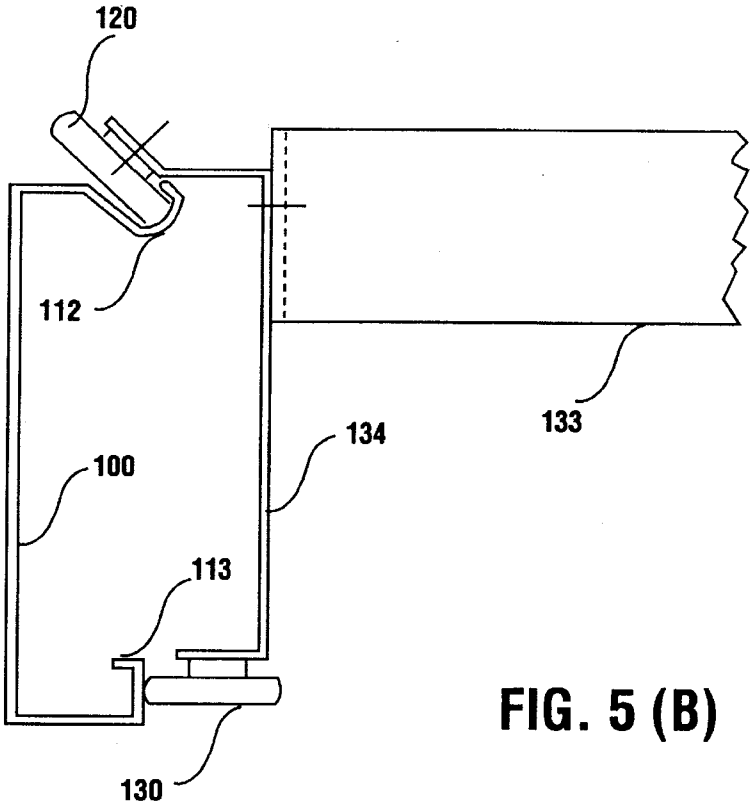
FIGS. 5A and 5B illustrate a second embodiment of the invention where the movable carrier is changed from a wire assembly to a riveted aluminum assembly.
Figure 5:
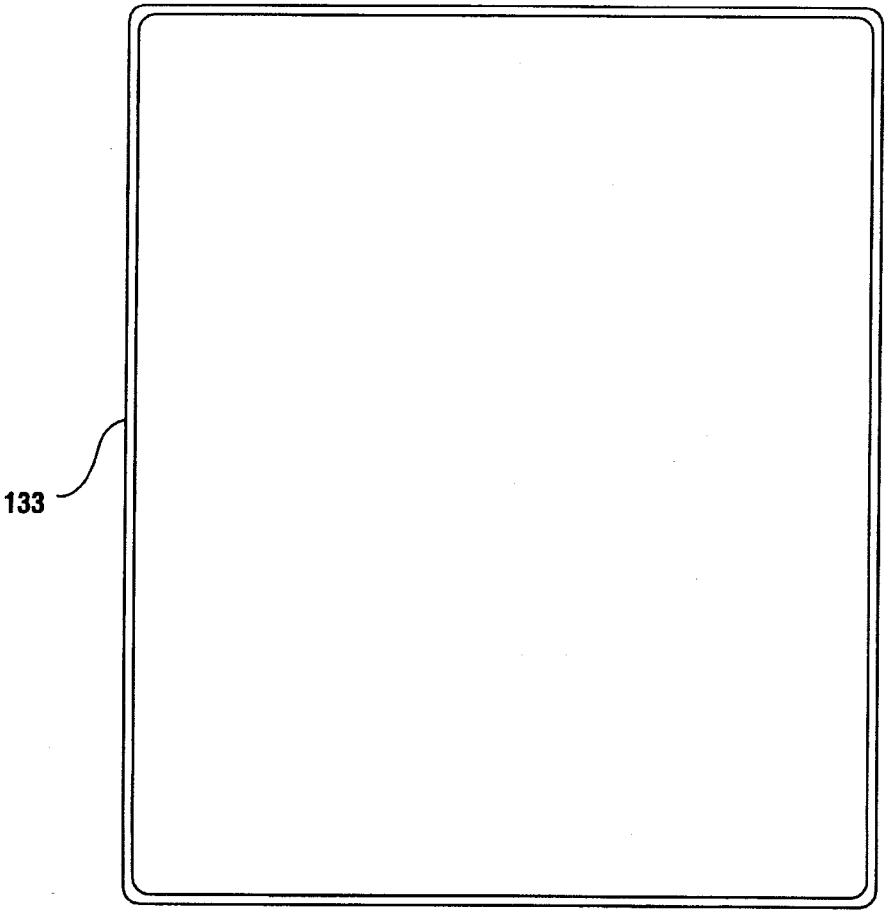

Referring now to FIGS. 5A and 5B, there is shown a second embodiment of the movable carrier of the instant invention, More particularly, carrier 133 is comprised of a riveted aluminum structure as opposed to the wire carrier structure 132 shown in FIG. 2. Carrier 133 is attached to a support member 134 by suitable attachment means. In turn, support member 134 has attached thereto rollers 120 and 130 which, in turn, cooperate with guides 112 and 113 in the manner described above to support movable carrier 133.

Referring now to FIGS. 6A–6D, there is shown yet another embodiment of the movable carrier of the instant invention. More particularly, the moveable carrier shown in FIG. 6A consists of two portions 140 and 141, which are attached with a hinge arrangement at 142. The hinge arrangement at 142 can be a conventional hinge, or a flexible plastic strip attached to portions 140 and 141.

Portions 140 and 141 have included therein a plurality of apertures such as apertures 146 and 147, which are useful in reducing the weight of the movable carrier.

Portion 141, also includes a center divider portion 145, which is useful in organizing files within the movable carrier.

Figure 6:
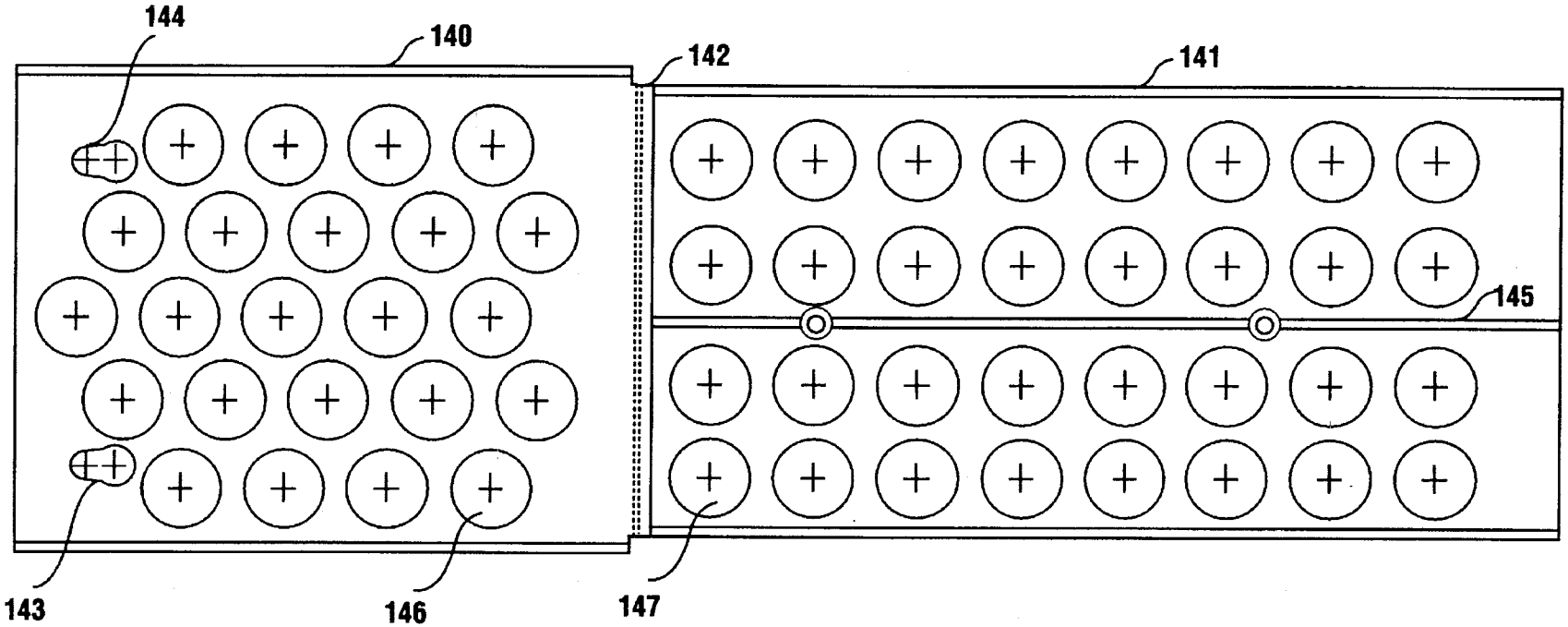
FIGS. 6A–6D illustrate a third embodiment of the movable carrier of the instant invention.
Figure 6:
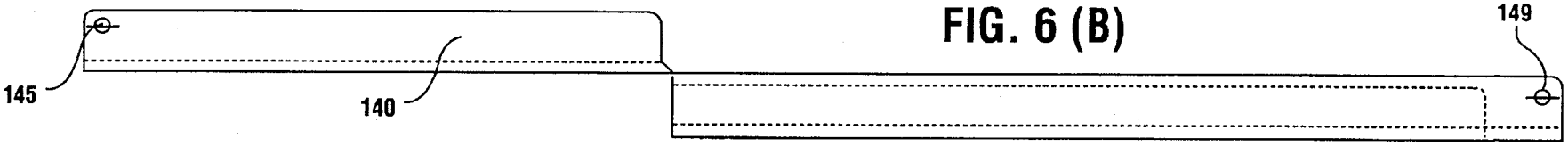
Figure 6:
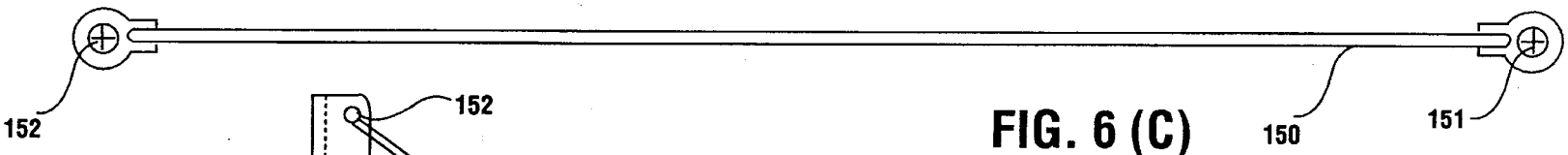
Figure 6:
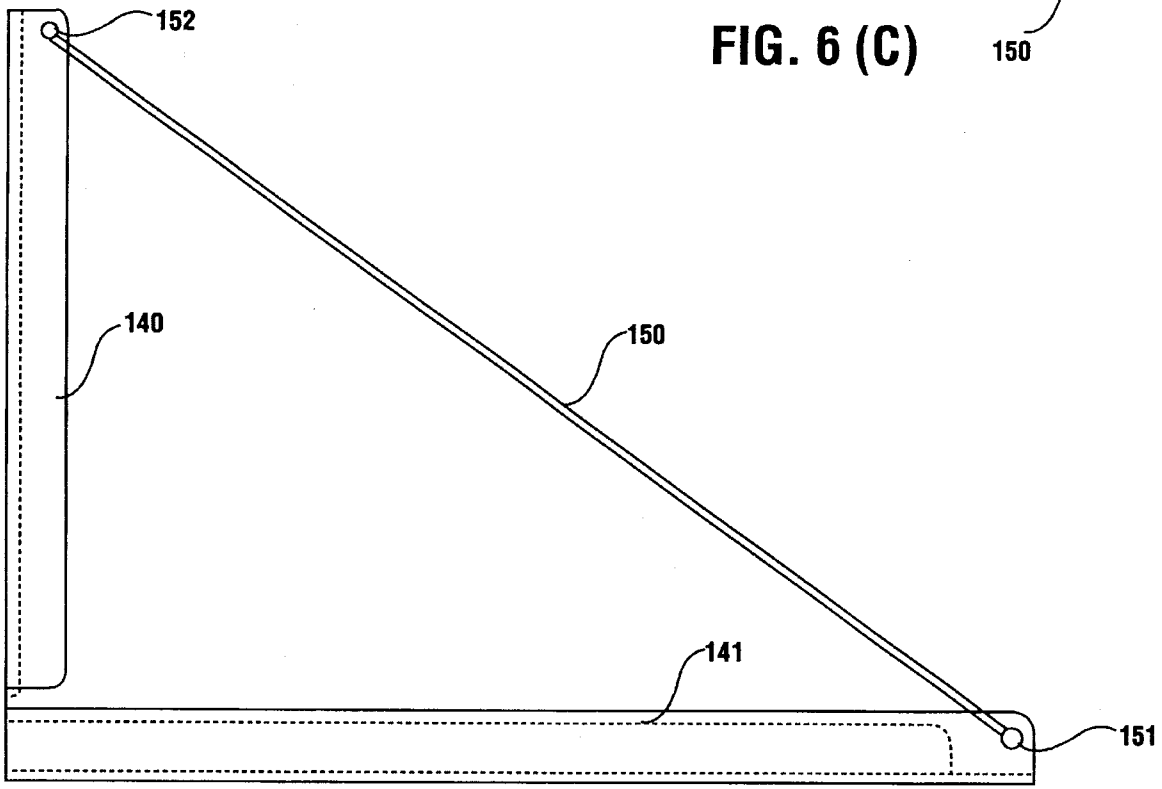

FIG. 6B illustrates a side view of the carrier shown in FIG. 6A. In use, the movable carrier is folded along hinge member 142, such that portion 140 is in a vertical position, and portion 141 is in a horizontal position as is shown in FIG, 6D. Portions 140 and 141 are then held in this position by strap 150 (FIG. 6C), which is attached at points 151 and 152, with any suitable fastening means.

Portion 140 is then attached to member 134 (FIG. 5B), at attachment points 143 and 144 (FIG. 6A). In this manner, the movable carrier shown in FIGS. 6A–6D operates in the manner described above to move horizontally with respect to other carriers.

The embodiment shown in FIGS. 6A–6D is particularly useful for the storage of "tab" folders which are widely used in the business community. Also, the use of hinge member 142 allows the carrier to lie flat, as shown in FIG. 6A for shipping and to be readily assembled for use as shown in FIG. 6D.

Though the invention has been described setting forth a three embodiments of the invention, various changes in the details of the construction may be made within the spirit of the invention. For instance, as described above, the carriers may be replaced by trays to hold not only paper, but other small items. These and other changes in the details may be made without departing from the principles of the invention, which is to be broadly construed and not to be limited except by the character of the claims appended hereto.

What is claimed is:

1. A simplified filing system comprising a plurality of horizontal support members having attached thereto an equal number of vertical support members, a plurality of horizontal support beams attached at predetermined locations to said vertical support members, each of said horizontal support beams including an upper and a lower guide portion, and a plurality of support carriages, selected ones of said support carriages including first and second roller means releasably attached to said upper and lower guide portions whereby selected ones of said support carriages move laterally along said horizontal support beams, said upper guide portion comprises an elongated recess area which cooperates with said first roller means and said lower guide portion comprises and elongated flange area which cooperates with said second roller means, said support carriages are arranged in a plurality of horizontal rows, a predetermined lower one of said horizontal rows of support carriages being fixed in position and predetermined upper ones of said horizontal rows of support carriages being laterally movable in position, whereby access to lower rows of support carriages is achieved, each of said support carriages include means for storing a plurality of items to be filed in said simplified filing system, and said storing means includes hanging file folders.

2. A simplified filing system in accordance with claim 1, wherein said storing means includes a storage basket.

3. A simplified filing system in accordance with claim 1, wherein said support carriages are comprised of a wire frame structure.

4. A simplified filing system in accordance with claim 1, wherein said support carriages are comprised of a riveted aluminum frame structure.

5. A simplified filing system comprising: vertical support members, horizontal support members for supporting said vertical support members, a plurality of horizontal support beams attached at predetermined locations to said vertical support members, each of said horizontal support beams including an upper and lower guide portion, and a plurality of support carriages, selected ones of said support carriages including first and second roller means releasably attached to said upper and lower guide portions whereby selected ones of said support carriages move laterally along said horizontal support beams, said upper guide portion comprises an elongated recess area which cooperates with said roller means and said lower guide portion comprises an elongated flange area which cooperates with said second roller means, said support carriages are arranged in a plurality of horizontal rows, a predetermined lower one of said horizontal rows of support carriages being fixed in position and predetermined upper ones of said horizontal rows of support carriages being laterally movable in position, whereby access to lower rows of support carriages is achieved, and each of said support carriages include means for storing a plurality of items to be filed in said simplified filing system.

6. A simplified filing system in accordance with claim 5, wherein said horizontal support members are attached to said vertical support members.

7. A simplified filing system in accordance with claim 5, wherein said storing means includes hanging file folders.

8. A simplified filing system in accordance with claim 5, wherein said storing means includes a storage basket.

9. A simplified filing system in accordance with claim 5, wherein said support carriages are comprised of a wire frame structure.

10. A simplified filing system in accordance with claim 5, wherein said support carriages are comprised of a riveted aluminum frame structure.

11. A simplified filing system comprising: vertical support members, horizontal support members for supporting said vertical support members, a plurality of horizontal support beams attached at predetermined locations to said vertical support members, each of said horizontal support beams including an upper and lower guide portion, and a plurality of support carriages, selected ones of said support carriages including first and second roller means releasably attached to said upper and lower guide portions whereby selected ones of said support carriages move laterally along said horizontal support beams, said upper guide portion comprises an elongated recess area which cooperates with said roller means and said lower guide portion comprises an elongated flange area which cooperates with said second roller means, said support carriages are arranged in a plurality of horizontal rows, predetermined ones of said horizontal rows of support carriages being laterally movable in position, each of said support carriages include means for storing a plurality of items to be filed in said simplified filing system, and said storing means includes hanging file folders.

12. A simplified filing system in accordance with claim 11, wherein said horizontal support members are attached to said vertical support members.

13. A simplified filing system in accordance with claim 11, wherein said storing means includes a storage basket.

14. A simplified filing system in accordance with claim 11, wherein said support carriages are comprised of a wire frame structure.

15. A simplified filing system in accordance with claim 11, wherein said support carriages are comprised of a riveted aluminum frame structure.

* * * * *